US007676892B2

(12) United States Patent
Tomory et al.

(10) Patent No.: US 7,676,892 B2
(45) Date of Patent: Mar. 16, 2010

(54) TIE DEVICE WITH CAM ACTION LOCK PAWL

(75) Inventors: Dennis G. Tomory, Boardman, OH (US); Robert Joseph Hrusovsky, Warren, OH (US); Peter T. Bucco, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/341,148

(22) Filed: Jan. 27, 2006

(65) Prior Publication Data

US 2007/0175001 A1 Aug. 2, 2007

(51) Int. Cl.
*B65D 63/00* (2006.01)

(52) U.S. Cl. ..... 24/16 PB

(58) Field of Classification Search ..... 24/16 R, 24/17 A, 17 AP, 16 PB, 30.5 R; 248/74.1–74.4
See application file for complete search history.

(56) References Cited

U.S. PATENT DOCUMENTS 3,588,962 A 6/1971 Feldberg
3,872,547 A * 3/1975 Caveney et al. ..... 24/16 PB
3,965,538 A * 6/1976 Caveney et al. ..... 24/16 PB
3,967,345 A 7/1976 Sumimoto
4,413,380 A 11/1983 Suzuki
4,490,887 A * 1/1985 Sarton et al. ..... 24/16 PB
5,055,066 A 10/1991 Garretson
5,459,907 A 10/1995 Nivet
5,669,111 A * 9/1997 Rohaly ..... 24/16 PB
5,803,413 A * 9/1998 Benoit et al. ..... 248/73
6,102,347 A * 8/2000 Benoit ..... 24/16 PB
6,149,109 A * 11/2000 Stankowski ..... 24/16 PB
6,718,597 B2 * 4/2004 Geiger ..... 24/16 PB
6,807,714 B2 * 10/2004 O'Young et al. ..... 24/16 PB
7,017,237 B2 * 3/2006 Magno et al. ..... 24/16 PB

* cited by examiner

*Primary Examiner*—Robert J Sandy
(74) *Attorney, Agent, or Firm*—Thomas N. Twomey

(57) ABSTRACT

A tie device has a tie strap and a buckle engaging serrations on a free end of the tie strap retaining the free end of the tie strap in the buckle A passage extends through the buckle from an insertion end to an exit end. A cam action lock pawl is located in the passage. The lock pawl has a first resilient leg that is attached to a fulcrum portion of the buckle; that slants upward with respect to a base wall of the passage toward the exit end of the passage and that terminates in a free end. The lock pawl has a second resilient leg that is attached to the first resilient leg and that extends back toward the insertion end of the passage. The second resilient leg has a plurality of teeth that are mutually engageable with respective serrations of the tie strap.

6 Claims, 2 Drawing Sheets

TIE DEVICE WITH CAM ACTION LOCK PAWL

FIELD OF THE INVENTION

This invention relates generally to a tie device and more particularly to a tie device with a buckle that has a lock pawl for holding the end of a tie strap.

BACKGROUND OF THE INVENTION

U.S. Pat. No. 5,055,066 granted to Jay H. Garretson Oct. 8, 1991 discloses an electrical connector having a buckle that has a lock pawl for holding the end of a tie strap. As best shown in FIG. 4 of the Garretson '066 patent, the lock pawl has a resilient leg that includes a triangular end tooth that engages one of several serrations incorporated into the free end of the tie strap when the end of the tie strap is pulled through the buckle. The geometry of the lock pawl is such that only the end tooth can engage one of the tie strap serrations to hold the end of the tie strap in the buckle. While the arrangement disclosed in the Garretson '066 patent is suitable for many purposes, the tension that can be applied to pull the locked tie strap back out of the buckle is limited. When the tension is high enough to shear off the end tooth, the end of the tie strap is released and the tie strap can be undone simply by pulling the tie strap back out of the insertion end of the buckle.

SUMMARY OF THE INVENTION

The tie device of the invention is an improvement over the arrangement disclosed in the Garretson '066 patent in that higher tension forces can be applied to the tie strap without the tie strap becoming undone. The tie device of the invention has a cam action lock pawl that clamps the end of the tie strap securely in the buckle and resists much greater tension or pull out forces in comparison to the prior art. Moreover, in comparison to the prior art, the tie device of the invention requires a relatively low engage force when the tie strap is inserted into locking engagement in the buckle. The cam action lock pawl includes a second tooth and preferably a third tooth that rotate or curl into locking engagement with different tie strap serrations as the tie strap is pulled through the buckle and wrapped tightly around a bundle of wires. Thus, the cam action lock pawl of the invention has at least two and preferably three lock faces engaging different tie strap serrations. This results in a more stable and reliable lock connection when the tie strap is tightened.

DETAILED DESCRIPTION OF PREFERRED EMBODIMENT

Figure 1:
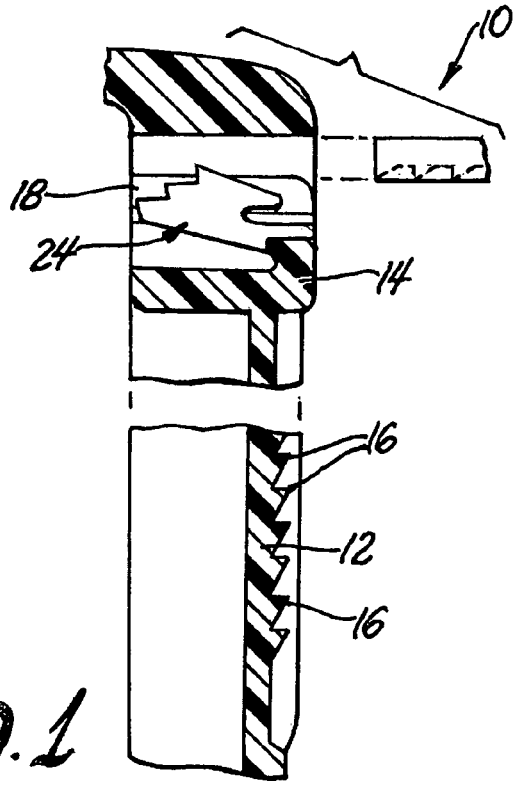
FIG. 1 is an elevational view of a tie device having a cam action lock pawl of the invention.

FIG. 1 discloses a tie device 10 of the invention having a tie strap 12 and a buckle 14 for engaging one of several serrations 16 incorporated into the tie strap 12 for retaining an end portion of the tie strap in the buckle. A passage 18 extends completely through buckle 14 from an insertion end 20 which receives the end portion of the tie strap 12 to an exit end 22 where the end portion of the tie strap 12 exits when the end portion of the tie strap 12 is pulled through the buckle 14. A cam action lock pawl 24 is located in passage 18 for engaging serrations 16 in the tie strap to hold the end portion of the tie strap in the buckle.

Figure 2:
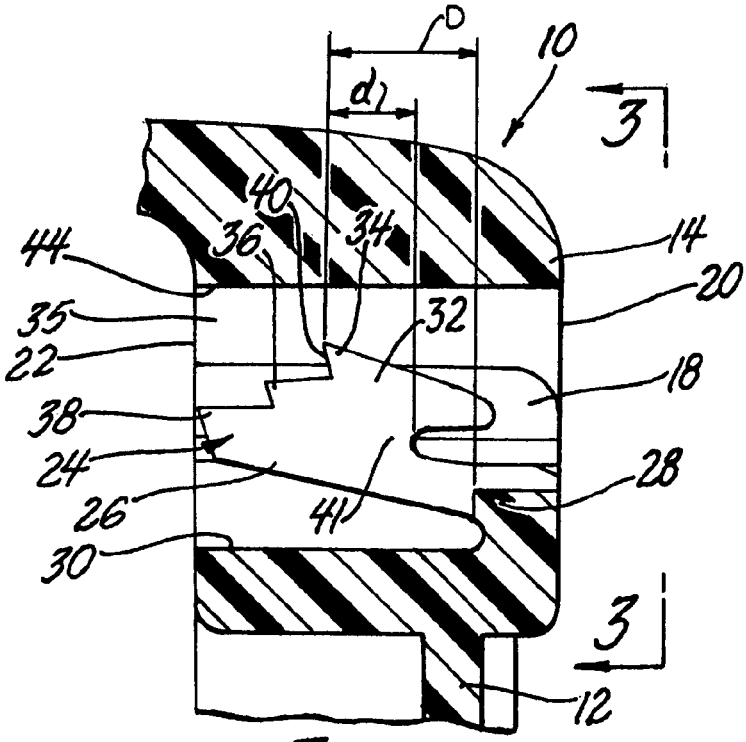
FIG. 2 is an enlargement of a portion of the tie device of FIG. 1 showing the cam action lock pawl in a stress free position prior to locking engagement with a serration of the tie strap.

Lock pawl 24 has a first resilient leg 26 that is attached to a fulcrum portion 28 of the buckle so that resilient leg 26 slants upward with respect to a base wall 30 of the passage toward the exit end 22 of the passage as best shown in FIG. 2. Resilient leg 26 terminates in a free end.

Lock pawl 24 has a second resilient leg 32 that is attached to first resilient leg 26 and that extends back toward the insertion end 20 of passage 18. The second resilient leg 32 has a plurality of teeth 34, 36 and 38 that are mutually engageable with respective serrations 16 of tie strap 16 to hold the end portion of the tie strap in the buckle 14. The plurality of teeth 34, 36 and 38 of the second resilient leg 32 includes a primary end tooth 34 that projects into the strap receiving portion 35 of passage 18 so that tooth 34 initially engages the serrations 16 of the tie strap. Primary end tooth 34 has a canted lock face 40 that slants back toward the base wall 30 and the insertion end 20 of the passage 18 as best shown in FIG. 2. Lock face 40 is spaced from the fulcrum portion 28 in a direction away from the insertion end 20 (and toward the exit end 22) of passage 18 by a predetermined distance D so that tension applied to the tie strap 12 to pull the tie strap 12 out of the insertion end 20 of the buckle 14 causes the resilient leg 26 to rotate or curl upwardly from the fulcrum portion 28 and away from the base wall 30 of passage 18.

Figure 5:
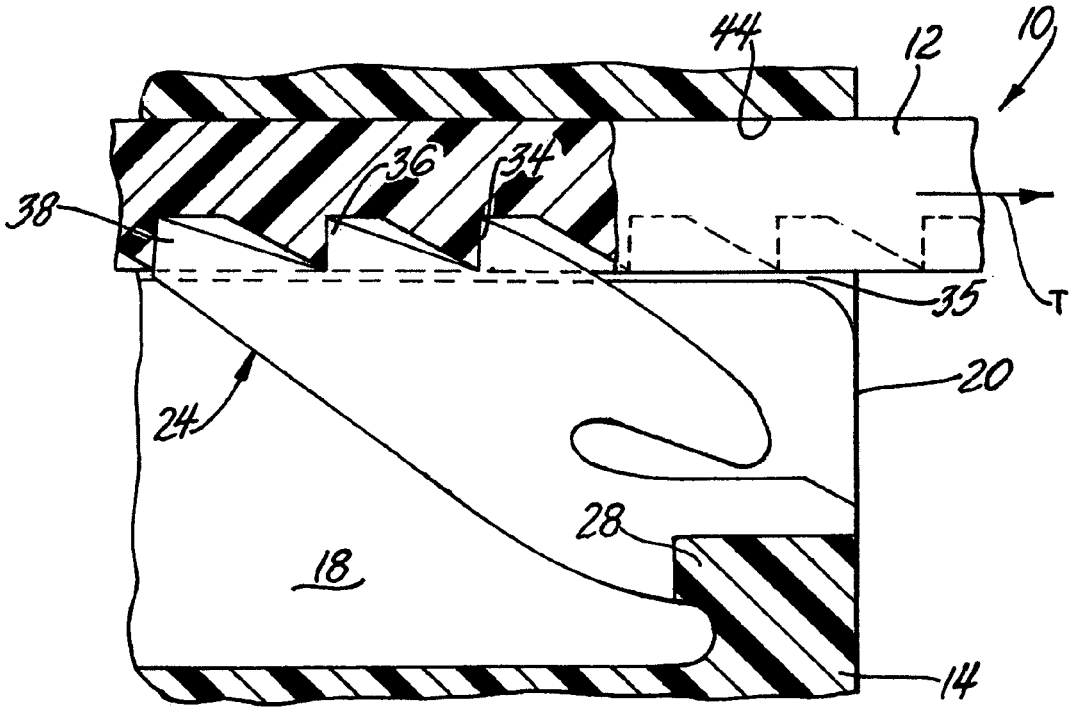
FIG. 5 is an enlargement of a portion of the tie device of FIG. 1 showing the cam action lock pawl in a third position after full locking engagement with the tie strap.

The first resilient leg 26 provides a second fulcrum portion 41 for the second resilient leg 32. The canted lock face 40 of the primary end tooth 34 is also spaced from the second fulcrum portion 41 in a direction away from the insertion end 20 by a predetermined distance d so that the tension applied to the tie strap 12 to pull the tie strap out of the insertion end 20 of the buckle also rotates or curls the second resilient leg 32 downwardly about the fulcrum portion 41 and toward the base wall 30 of the passage 18 causing teeth 36 and 38 to project into passage portion 35 and engage respective serrations 16 as best shown in FIG. 5.

Figure 3:
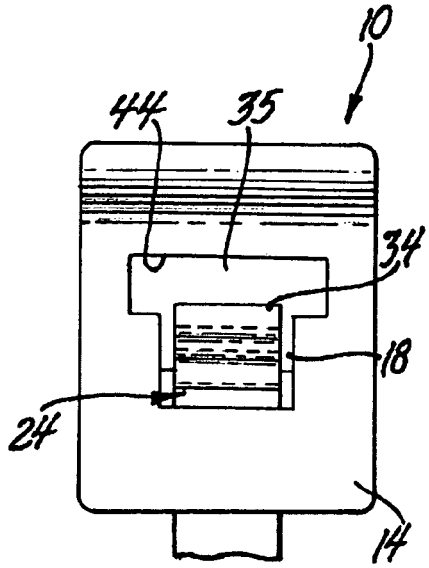
FIG. 3 is an enlarged sectional view taken along the line 3-3 of FIG. 2 looking in the 10 direction of the arrows.

The distance D and d vary depending upon the material of buckle 14 and the configuration of the cam action lock pawl 24. In any event, the first fulcrum portion 28 is preferably closer to the insertion end of the passage than the second fulcrum portion 40. The strap receiving portion 35 of passage 18 preferably provides a track that has a width dimensioned for guiding the free end portion of the strap 12 through the passage 18 of the buckle as best shown in FIG. 3.

The cam action lock pawl 24 has at least two and preferably three lock teeth. These lock teeth 34, 36, and 38 may be formed in the line of draw of an injection mold for molding buckle 14 as part of tie strap 12 as best shown in FIGS. 1 and 2. This configuration reduces the complexity of the forming tool greatly, decreases tool wear and breakage, and lowers manufacturing cost. The term "line of draw" is a term of art and as used herein means that as the mold moves in a line, the mold can be pulled apart from the surface formed by the mold free from interference from an undercut or other part.

Figure 4:
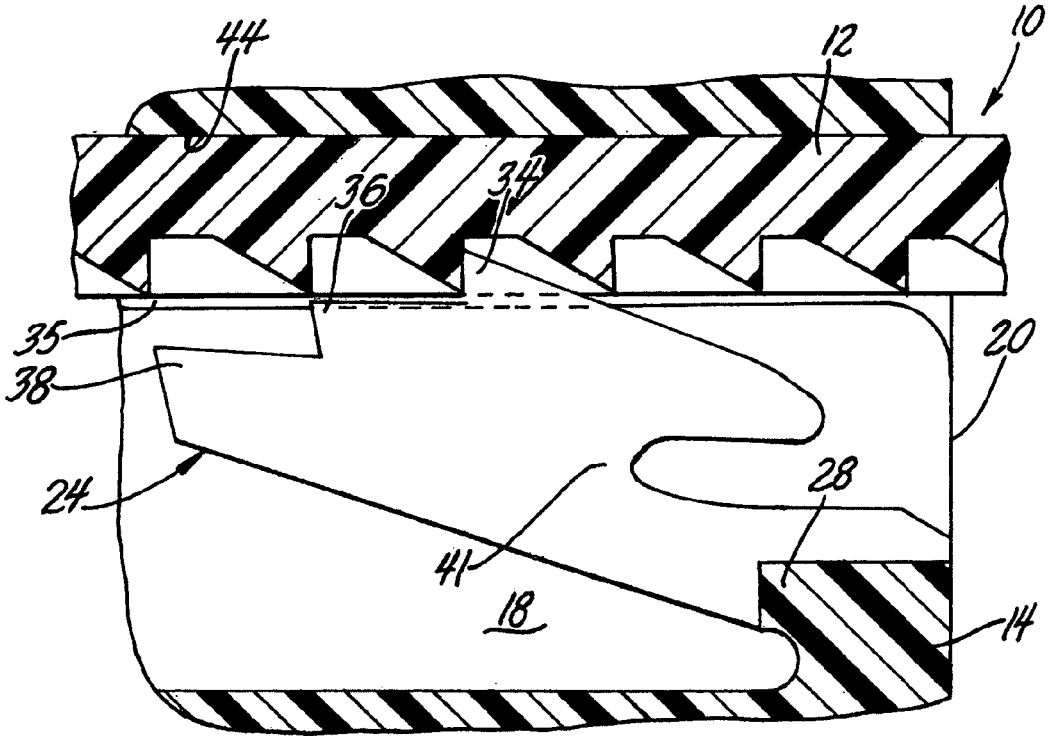
FIG. 4 is an enlargement of a portion of the tie device of FIG. 1 showing the cam action lock pawl in a second position after an initial locking engagement with the tie strap.

The primary end lock tooth 34 locks the end of tie strap in buckle 14 when the end of the tie strap 12 is inserted through passage 18 via insertion end 20 with a relatively low force as shown in FIG. 4. This relatively low engage force is a feature that is desired at manufacturing plants.

After the initial locking engagement shown in FIG. 4, the tie strap 12 is pulled through passage 18 until the tie strap 12 is wrapped tightly around a bundle of wires (not shown) so that the bundle of wires pulls back on the tie strap 12 producing a tension indicated by the arrow T in FIG. 5. As the bundle of wires pull the tie strap 12 back out the insertion end 20 of passage 18, the first resilient leg 26 of cam action pawl 24 rotates or curls upwardly from the fulcrum portion 28 and away from the base wall 30 of passage 18 while the second resilient leg 32 rotates or curls downwardly about the fulcrum portion 41 and toward the base wall 30 of the passage 18 causing teeth 36 and 38 to project into passage portion 35 and engage respective serrations 16 as best shown in FIG. 5. The curled cam action lock pawl 24 reacts by pushing the tie strap 12 toward the exit end 22 of passage 18 increasing the tension in the tie strap 12 and clamping the end portion of the tie strap 12 tightly against the top wall 44 of the strap receiving portion 35 of the passage 18.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A tie device having a tie strap and a buckle for engaging serrations on a free end of the tie strap for retaining the free end of the tie strap in the buckle, the buckle having a passage extending through the buckle from an insertion end for receiving the free end of the tie strap to an exit end for exiting the free end of the tie strap, and a cam action lock pawl located in the passage for engaging the serrations on the free end of the tie strap to hold the free end of the tie strap in the buckle characterized in that:

the lock pawl has a first resilient leg that is attached to a fulcrum portion of the buckle, the first resilient leg slants upward with respect to a base wall of the passage toward the exit end of the passage and that terminates in a free end, the lock pawl has a second resilient leg that is attached to the first resilient leg through a second fulcrum position with said second resilient leg extending back toward the insertion end of the passage, the second resilient leg has at least three teeth axially spaced in the passage between the insertion end and exit end with each tooth having a lock face, said at least three teeth of the second resilient leg includes a primary end tooth that initially engages the serrations of the tie strap, said primary end tooth being dimensioned such that when said serrations abut said primary end tooth when said tie strap is moving forward from said insertion end to said exit end said primary tooth engages said serrations and remaining teeth of said at least three teeth remain disengaged from said serrations, and the primary tooth has its lock face slanting back toward the base wall and the insertion end of the passage when it alone is engaged to the serrations, said primary tooth is spaced from the fulcrum portion away from the insertion end by a predetermined distance so that tension applied to the tie strap to pull the tie strap out of the insertion end of the buckle rotates the first resilient leg away from the base wall of the passage, and rotates the second resilient leg toward the base wall of the passage so that remaining teeth of said at least three teeth engage respective serrations of the tie strap to hold the free end of the tie strap in the buckle with the lock faces of all the respective teeth becoming perpendicular to the base wall of the passage and engaging said serrations.

2. The tie device as defined in claim 1 wherein the canted lock face of the primary end tooth is spaced from the second fulcrum portion away from the insertion end.

3. The tie device as defined in claim 2 wherein the first fulcrum portion is closer to the insertion end of the passage than the second fulcrum portion.

4. The tie device of claim 3 wherein the passage has a track portion for guiding the free end of the tie strap through the passage of the buckle.

5. The tie device of claim 4 wherein the primary end tooth extends into the track portion of the passage when the lock pawl is in an unstressed state.

6. A tie device as defined in claim 1 wherein said at least three teeth of said second leg and said first resilient leg above said second fulcrum are formed in the line of draw of an injection mold free from interference with said resilient first leg above said second fulcrum and respective lock face of each tooth that freely and fully faces the exit end.

* * * * *